US012448769B2

(12) United States Patent
Fellabaum et al.

(10) Patent No.: US 12,448,769 B2
(45) Date of Patent: Oct. 21, 2025

(54) MODULAR WELL CELLAR

(71) Applicant: NATIONAL OILWELL VARCO, L.P., Houston, TX (US)

(72) Inventors: Chad A. Fellabaum, Belle Vernon, PA (US); Justin M. Tyson, Spring, TX (US); Darrius Jeurimo Dias, College Station, TX (US); Kyle Sanborn, Dallas, TX (US); Nicklas Baginski, Austin, TX (US); Matthew Fanaff, Cypress, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 603 days.

(21) Appl. No.: 17/814,054

(22) Filed: Jul. 21, 2022

(65) Prior Publication Data

US 2024/0026674 A1 Jan. 25, 2024

(51) Int. Cl.
*E04B 1/00* (2006.01)
*E04B 1/343* (2006.01)
*E21B 15/00* (2006.01)

(52) U.S. Cl.
CPC ..... *E04B 1/0015* (2013.01); *E04B 1/34336* (2013.01); *E21B 15/00* (2013.01)

(58) Field of Classification Search
CPC .... E04B 1/0015; E04B 1/34336; E21B 15/00; E21B 41/00; E21B 33/03
See application file for complete search history.

(56) References Cited

U.S. PATENT DOCUMENTS

| | | | | |
|---|---|---|---|---|
| 4,546,896 | A | 10/1985 | Reid | |
| 7,637,692 | B1 | 12/2009 | Rose | |
| 8,485,250 | B1 * | 7/2013 | Rose | E21B 43/0122 405/52 |
| 9,555,959 | B1 | 1/2017 | Ziegs | |
| 2003/0150769 | A1 | 8/2003 | Lau | |
| 2010/0089917 | A1 | 4/2010 | Gilbert et al. | |
| 2019/0040705 | A1 | 2/2019 | Stierwalt | |
| 2020/0040711 | A1 * | 2/2020 | Rose | E21B 41/00 |
| 2020/0141109 | A1 * | 5/2020 | Pospisil | E02D 17/13 |

(Continued)

OTHER PUBLICATIONS

"International Application Serial No. PCT US2023 070050, International Search Report mailed Sep. 8, 2023", 5 pgs.

(Continued)

*Primary Examiner* — Babajide A Demuren
(74) *Attorney, Agent, or Firm* — Schwegman Lundberg & Woessner, P.A.

(57) ABSTRACT

A modular well cellar system can include a planar base member defining an aperture sized to receive a conductor pipe; a first end member secured to the base member and configured to support a first lateral wall of the well cellar excavation; a first side member secured to the base member, the first end member, and the second end member, and configured to support a first longitudinal wall of the well cellar excavation; a second side member secured to the planar base member and the first end member and configured to support a second longitudinal wall of the well cellar excavation; and a seal formed between a top surface of the planar base member and each of the first end member, the first side member, and the second side member.

22 Claims, 8 Drawing Sheets

(56) References Cited

U.S. PATENT DOCUMENTS

2023/0107830 A1* 4/2023 Thierry ..... E21B 41/00
166/381

OTHER PUBLICATIONS

"International Application Serial No. PCT US2023 070050, Written Opinion mailed Sep. 8, 2023", 6 pgs.
"International Application Serial No. PCT US2023 070050, International Preliminary Report on Patentability mailed Jun. 10, 2024", 7 pgs.

* cited by examiner

MODULAR WELL CELLAR

TECHNICAL FIELD

This document pertains generally, but not by way of limitation, to containment well cellars for installation below ground level at oil or gas extraction sites.

BACKGROUND

In the field of fossil fuel extraction, a containment well cellar can be positioned within an excavation at a well site, such as underneath a drilling rig structure. The containment well cellar can be liquid-tight to prevent lubricants, oil, or other fluids used during drilling operations from leaking into the surrounding subterranean area. Such leaks can create severe ecological pollution that can be expensive and time-consuming to remedy. The well cellar can also allow workers to access drilling or wellhead equipment located below ground level (e.g., below grade), such as by including internal stairways, ladders, handrails, or other user-access features, while preventing the earthen walls of the excavation from collapsing inward onto the drilling or wellhead equipment. Additionally, the containment well cellar can help to support a drilling casing, withstand side-loading pressures from the drilling rig structure, and provide a covered surface to support heavy equipment or truck traffic.

Traditional containment well cellars are generally shipped to a well site in a monolithic (e.g., precast, unitary, or fixedly pre-assembled) state to reduce the potential for fluid leaks and simplify the manufacturing process. However, a monolithic containment well cellar can be both heavy and very large in scale. This can present significant challenges to the manufacture, shipping, and installation of containment well cellars. First, for example, some containment well cellars are galvanized to inhibit corrosion or rust formation in a subterranean environment. However, the galvanization process is most-commonly performed by dipping into a bath of molten zinc, and few facilities operate baths capable of accommodating a containment well cellar. This can increase the manufacturing cost and increase customer wait times by necessitating transport to and from such facilities. Second, the large external dimensions of a monolithic containment well cellar can make long-distance shipping, such as to international locations, very costly or even cost prohibitive; and can limit transportation options, such as to large vehicles that may not be able to access remote drilling locations. Third, installing a monolithic containment well cellar, such as by lifting the containment cellar from a transport vehicle and lowering the containment cellar into an excavation at a well site, can be a difficult and potentially hazardous operation requiring precise control of heavy equipment, such as an overhead crane.

OVERVIEW

In view of the above, the present inventor has recognized, among other things, that the problems to be solved in containment well cellar production, shipping, and installation can include time-consuming manufacturing, costly shipping, and difficult or hazardous installation. The present disclosure can help to address these issues, among others, such as by providing a modular well cellar system capable of being shipped to well site in a disassembled state, such as in a flat-pack arrangement. For example, the modular well cellar system can include a first side member onto which a second side member, a planar base member, a first end member, and a second end member can be horizontally stacked for shipping to a well site. Such a flat-pack arrangement can greatly reduce the shipping height, and thereby reduce the shipping cost, of a containment well cellar. Further, as the modular well cellar system can be transported in a disassembled state, the modular well cellar system can be transported on smaller vehicles that can access remote drilling locations.

Subsequently, the planar base member, the first side member, the second side member, the first end member, and the second end member can be secured and sealed to one another at a well site. This can eliminate the need for, and thereby the risks associated with, lifting or maneuvering a monolithic containment well cellar at a well site. Further, as the planar base member, the first side member, the second side member, the first end member, and the second end member are much smaller individually, relative to an assembled or otherwise monolithic containment well cellar, the planar base member, the first side member, the second side member, the first end member, and the second end member can be galvanized at a greater number of galvanization facilities. This can help to increase production output to thereby reduce customer wait-times. In view of the above, the modular well cellar system can help to improve aspects of containment well cellar production, shipping, and installation.

In an example, the modular well cellar comprises: a planar base member for placement below grade in a well cellar excavation and defining an aperture sized to receive a conductor pipe; a first end member secured to the base member and configured to support a first lateral wall of the well cellar excavation; a first side member secured to the base member, the first end member, and the second end member, the first side member configured to support a first longitudinal wall of the well cellar excavation; and a second side member secured to the planar base member and the first end member, the second side member configured to support a second longitudinal wall of the well cellar excavation; and a seal formed between a top surface of the planar base member and each of the first end member, the first side member, and the second side member.

In another example, a method of assembling a modular well cellar system comprises: depositing a sealing material on a first side member; securing the first side member to a first end member to establish a seal between the first side member and the first end member; depositing a sealing material a second side member, securing the second side member to the first end member to establish a seal between the second side member and the first end member; depositing a sealing material on a top surface of a planar base member; and securing the first side member, the second side member, and the first end member to the top surface of the planar base member to establish a seal between the planar base member and the first side member, the second side member, and the first end member, wherein the seal between the first side member and the first end member and the seal between the second side member and the first end member is longitudinally offset from a corner of the planar base member.

This overview is intended to provide a summary of subject matter of the present patent application, It is not intended to provide an exclusive or exhaustive explanation of the invention. The detailed description is included to provide further information about the present patent application.

Figure 1:
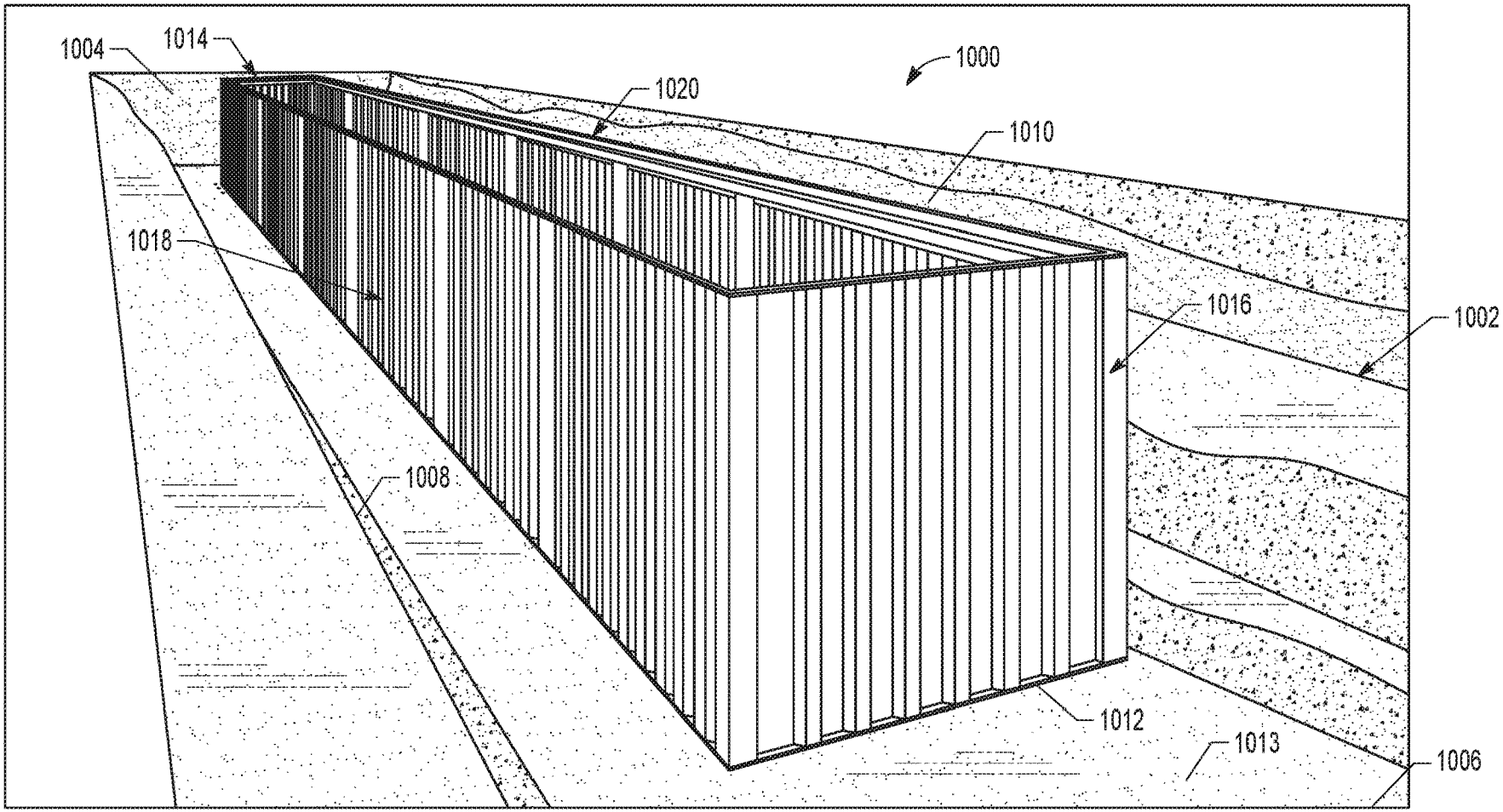
FIG. 1 illustrates a perspective view of an example modular well cellar system positioned within a well cellar excavation.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

FIG. 1 illustrates a perspective view of an example modular well cellar system 1000 positioned within a well cellar excavation 1002. The well cellar excavation 1002 can be an area at a well site where earth is removed to receive the modular well cellar system 1000. In a non-limiting example, such as shown in FIG. 1, the well cellar excavation 1002 can be rectangular in shape, such as including a first lateral wall 1004, a second lateral wall 1006, a first longitudinal wall 1008, and a second longitudinal wall 1010. In such an example, the modular well cellar system 1000 can include a planar base member 1012, a first end member 1014, a second end member 1016, a first side member 1018, and a second side member 1020. The first end member 1014 and the second end member 1016 can each be secured, and sealed, to the first side member 1018 and the second side member 1020. The first end member 1014, the second end member 1016, the first side member 1018, and the second side member 1020 can be secured, and sealed, to the planar base member 1012. In this manner, the modular well cellar system 1000 can be liquid-tight to prevent lubricants, oil, or other fluids used during drilling operations from leaking into the surrounding subterranean area.

In a non-limiting example, the first end member 1014 can be configured to support the first lateral wall 1004, a portion of the first longitudinal wall 1008, and a portion of the second longitudinal wall 1010; and the second end member 1016 can be configured to support the second lateral wall 1006, a portion of the first longitudinal wall 1008, and a portion of the second longitudinal wall 1010. For example, the first end member 1014 and the second end member 1016 can be U-shaped wall sections of sufficient structural integrity to prevent the modular well cellar system 1000 from collapsing inwardly under pressure applied by surrounding terrain.

The first end member 1014 and the second end member 1016 can also help the modular well cellar system 1000 resist forces applied to the modular well cellar system 1000 by a drilling rig or other associated equipment during a drilling operation over time. For example, such a U-shape can enable a seal formed between the first end member 1014 and the first side member 1018, and a seal formed between the first end member 1014 and the second side member 1020, to be located in a position longitudinally offset from a corner of the planar base member 1012. This can reduce, relative to a seal located in a position vertically aligned with a corner of the planar base member 1012, the torsional forces that such seals are subjected to during a drilling operation.

The first side member 1018 can be configured to support a portion of the first longitudinal wall 1008; and the second side member 1020 can be configured to support a portion of the second longitudinal wall 1010. For example, the first end member 1014 and the second end member 1016 can be flat, or planar, wall sections of sufficient structural integrity to prevent the modular well cellar system 1000 from collapsing inwardly under the pressure applied by surrounding terrain. The first side member 1018 and the second side member 1020 can also help the modular well cellar system 1000 expand to meet the requirements of various well sites. For example, two or more of the first side member 1018 and two or more more of the second side member 1020 can be secured, and seal to, one another, and to the first end member 1014 and the second end member 1016, to form longer longitudinal side walls. This modularity can allow the modular well cellar system 1000 to support the needs of various different drilling operations without necessitating a bespoke order or modification at a well-site.

Figure 2:
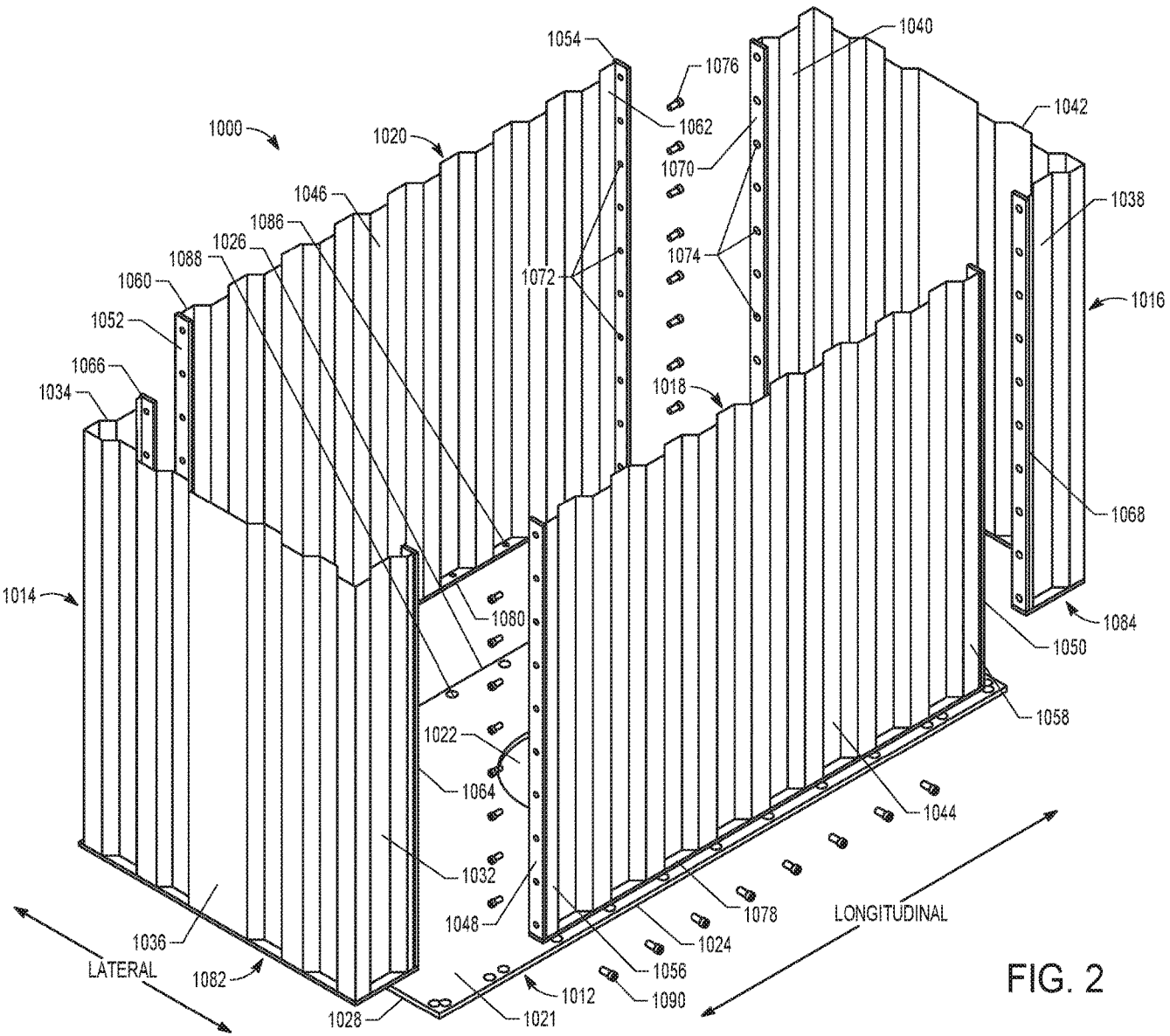
FIG. 2 illustrates an exploded view of an example modular well cellar system
Figure 3A:
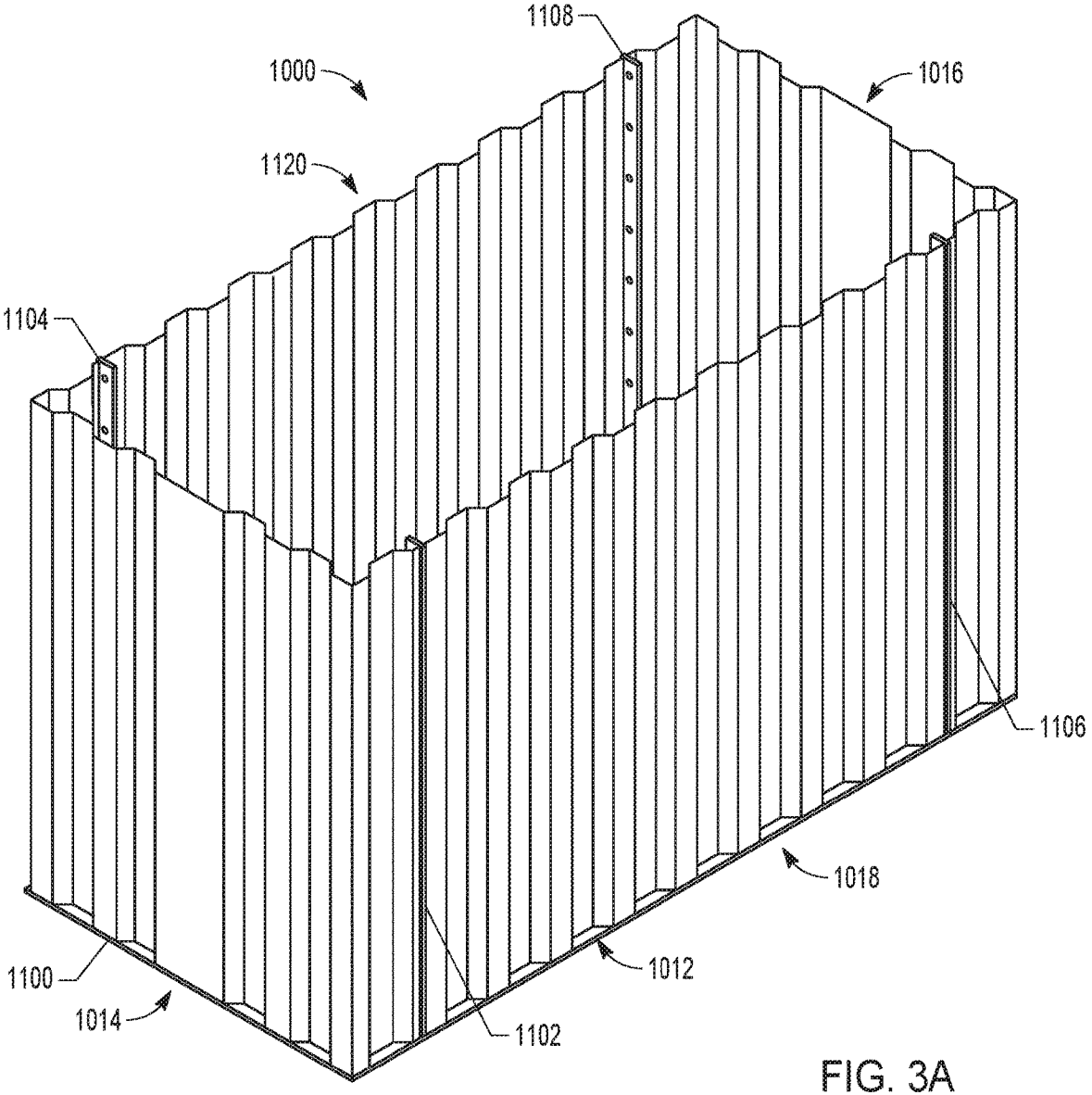
FIG. 3A illustrates a modular well cellar system in an assembled state.
Figure 3B:
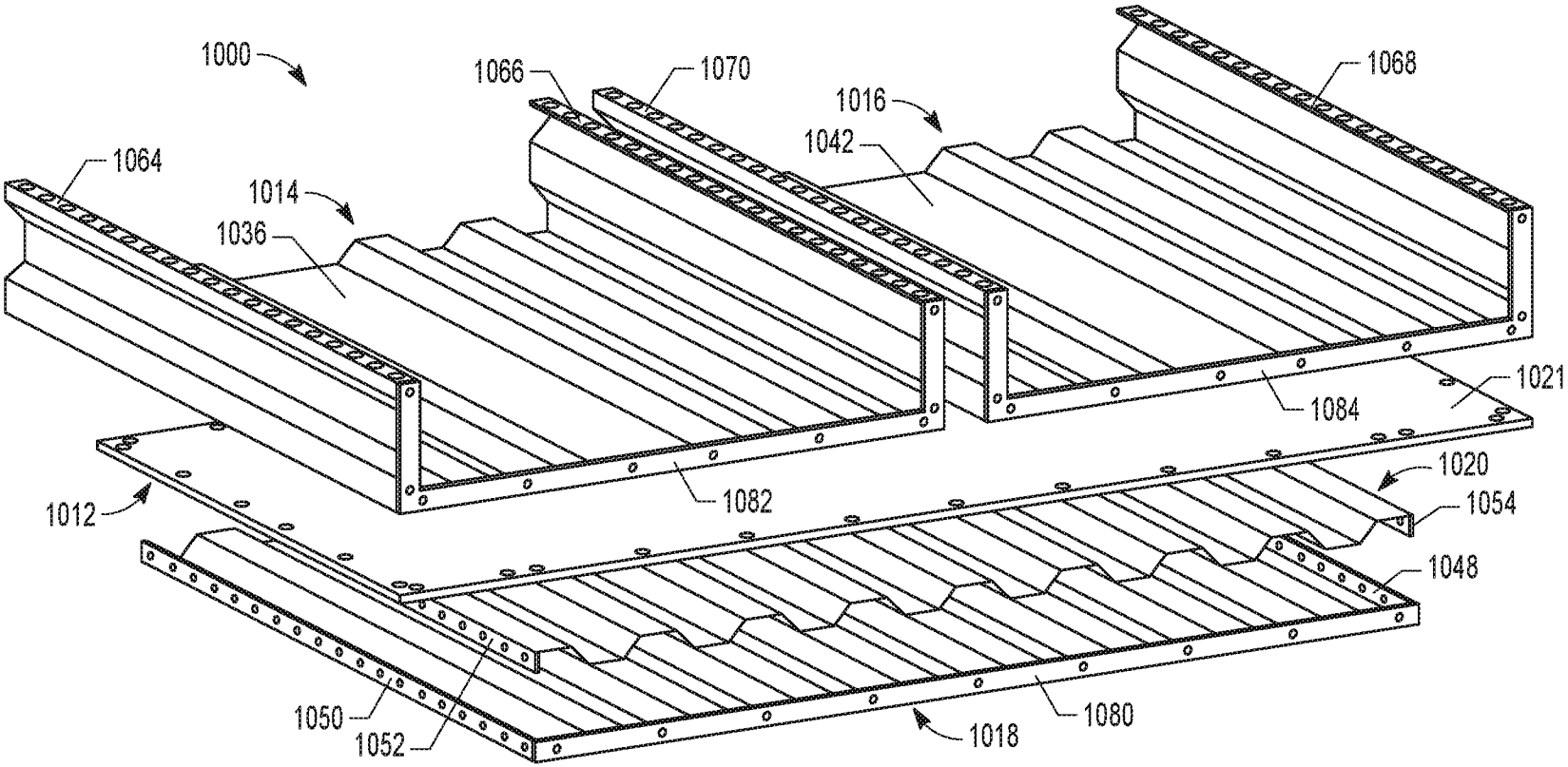
FIG. 3B illustrates a modular well cellar system in a disassembled state.

In the operation of some examples, the planar base member 1012, the first end member 1014, the second end member 1016, the first side member 1018, and the second side member 1020 can be shipped to a well site including the well cellar excavation 1002 in the disassembled state illustrated in FIG. 3B. The planar base member 1012 can be positioned on a ground surface 1013 located below grade within the well cellar excavation 1002, such as to form a floor surface of the modular well cellar system 1000. A sealing material can be deposited on a surface of any of the first end member 1014, the second end member 1016, the first side member 1018, and the second side member 1020. The first end member 1014 can be secured to both the first side member 1018 and the second side member 1020, and the second end member 1016 can be secured to both the first side member 1018 and the second side member 1020, such as via a plurality of fasteners as illustrated in FIG. 2.

In this manner, a liquid-tight seal can be established between the first end member 1014 and both of the first side member 1018 and the second side member 1020, a between the second end member 1016 and both of the first side member 1018 and the second side member 1020. A sealing material can then be deposited on the planar base member 1012; and the first end member 1014, the second end member 1016, the first side member 1018, and the second side member 1020 can each be secured to the planar base member 1012. In this manner, a liquid-tight seal can be established between the planar base member 1012 and each of the first end member 1014, the second end member 1016, the first side member 1018, and the second side member 1020, such as to bring the modular well cellar system 1000 into an assembled state, such as illustrated in FIG. 3A, Subsequently, soil or other filling materials can be backfilled against the modular well cellar system 1000, internal stairways, ladders, handrails, or other user-access features can be installed within the modular well cellar system 1000, and a cover plate or grating can be installed to support workers or vehicle traffic above the modular well cellar system 1000.

Figure 4A:
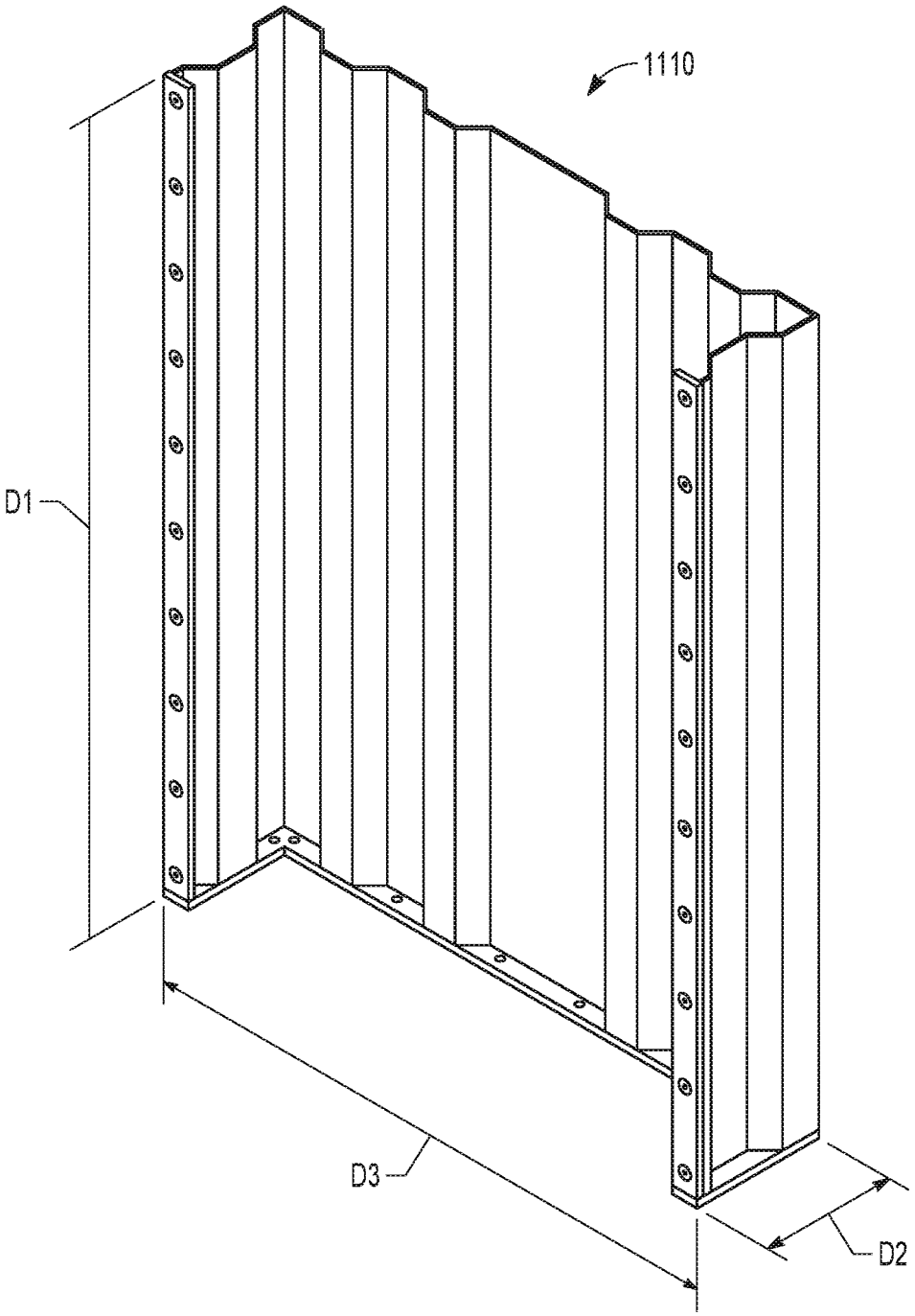
FIG. 4A illustrates an isometric view of an example end member.

FIG. 2 illustrates an exploded view of an example modular well cellar system 1000. Also shown in FIG. 2 are directional indicators Lateral and Longitudinal. FIG. 2 is discussed with reference to the modular well cellar system 1000 shown in, and described with regard to, FIG. 1 above. In a non-limiting example, the planar base member 1012 can define a top surface 1021 and an aperture 1022, a first longitudinal surface 1024, a second longitudinal surface 1026, a first lateral surface 1028, and a second lateral surface 1030 (FIG. 4A). The aperture 1022 can extend vertically through the planar base member 1012; and can be configured to receive a conductor pipe. For example, the aperture 1022 can be sized and shaped to engage a seal, riser, or other feature configured to extend through the aperture to establish a liquid-tight seal between the conductor pipe and the planar base member 1012.

The first end member 1014 can include a first planar portion 1032, a second planar portion 1034, and a third planar portion 1036; and the second end member 1016 can include a first planar portion 1038, a second planar portion 1040, and a third planar portion 1042. The first planar portion 1032, the second planar portion 1034, and the third planar portion 1036 can be rectangular or square panels. The first planar portion 1032, the second planar portion 1034, and the third planar portion 1036, and the first planar portion 1038, the second planar portion 1040, and the third planar portion 1042, can be integrally formed, or otherwise fixedly coupled to another, such as via welding, riveting, or other fastening means. The third planar portion 1036 of the first end member 1014 can extend orthogonally to the first planar portion 1032 and the second planar portion 1034; and the third planar portion 1042 of the second end member 1016 can extend orthogonally to the first planar portion 1038 and the second planar portion 1040.

The first end member 1014 can be positioned relative to the planar base member 1012, such that the first planar portion 1032 extends parallel to, or flush with, the first longitudinal surface 1024, the second planar portion 1034 extends parallel to, or flush with, the second longitudinal surface 1026, and the third planar portion 1036 extends parallel to, or flush with, the first lateral surface 1028. Similarly, the second end member 1016 can be positioned relative to the planar base member 1012, such that the first planar portion 1038 extends parallel to, or flush with, the first longitudinal surface 1024, the second planar portion 1040 extends parallel to, or flush with, the second longitudinal surface 1026, and the third planar portion 1042 extends parallel to, or flush with, the second lateral surface 1030.

The first side member 1018 can include a planar portion 1044 and the second side member 1020 can include a planar portion 1046. The planar portion 1044 of the first side member 1018 and the planar portion 1046 of the second side member 1020 can be rectangular or square panels. The first side member 1018 can be positioned relative to the planar base member 1012, such that the planar portion 1044 extends parallel to, or flush with, the first longitudinal surface 1024. The second side member 1020 can be positioned relative to the planar base member 1012, such that the planar portion 1046 extends parallel to, or flush with, the second longitudinal surface 1026.

The first side member 1018 can include a first vertical side flange 1048 and a second vertical side flange 1050. The second side member 1020 can include a first vertical side flange 1052 and second vertical side flange 1054. The first vertical side flange 1048 and the second vertical side flange 1050 of the first side member 1018, and the first vertical side flange 1052 and the second vertical side flange 1054 of the second side member 1020, can be, for example, but not limited to, segments of flat bar stock or angle iron fixedly coupled to the first side member 1018 and the second side member 1020, respectively. The first vertical side flange 1048 can extend laterally inwardly from a first end 1056 of the planar portion 1044; and the second vertical side flange 1050 can extend laterally inwardly from a second end 1058 of the planar portion 1044. The first vertical side flange 1052 can extend laterally inwardly from a first end 1060 of the planar portion 1046; and the second vertical side flange 1054 can extend laterally inwardly from a second end 1062 of the planar portion 1046.

The first end member 1014 can include a first vertical end flange 1064 and a second vertical end flange 1066. The first vertical end flange 1064 and the second vertical end flange 1066 can be, for example, but not limited to, a bent portion of the first end member 1014, segments of flat bar stock, or angle iron fixedly coupled to the first end member 1014. The first vertical end flange 1064 can extend laterally inwardly from the first planar portion 1032, and the second vertical end flange 1066 can extend laterally inwardly from the second planar portion 1034. The second end member 1016 can include a first vertical end flange 1068 and a second vertical end flange 1070. The first vertical end flange 1068 and the second vertical end flange 1070 can be, for example, but not limited to, a bent portion of the second end member 1016, segments of flat bar stock, or angle iron fixedly coupled to the second end member 1016. The first vertical end flange 1068 can extend laterally inwardly from the first planar portion 1038 and the second vertical end flange 1070 can extend laterally inwardly from the second planar portion 1040.

The first vertical side flange 1048, the second vertical side flange 1050, the first vertical side flange 1052, the second vertical side flange 1054, the first vertical end flange 1064, the second vertical end flange 1066, the first vertical end flange 1068, and the second vertical end flange 1070 can enable the first side member 1018 and the second side member 1020 to be secured to the first end member 1014 and the second end member 1016. For example, the second vertical side flange 1054 of the second side member 1020 can define a one or more first bores 1072 and second vertical end flange 1070 of the second end member 1016 can define one or more second bores 1074. For the sake of brevity, the one or more first bores 1072 is discussed below with reference to the second vertical side flange 1054; and the one or more second bores 1074 is discussed below with reference to the second vertical end flange 1070. However, the first vertical side flange 1048 and the second vertical side flange 1050 of the first side member 1018, and the first vertical side flange 1052 of the second side member 1020, can each include one or more first bores 1072. Similarly, the first vertical end flange 1064 and the second vertical end flange 1066 of the first end member 1014, and the first vertical end flange 1068 of the second end member 1016, can each include one or more second bores 1074.

The one or more first bores 1072 can extend longitudinally through the second vertical side flange 1054 and the one or more second bores 1074 can extend longitudinally through the second vertical end flange 1070. The one or more first bores 1072 or the one or more second bores 1074 can be threaded, such as by including threaded inserts. The one or more first bores 1072 and the one or more second bores 1074 can define, for example, but not limited to, two, three, five, six, seven, eight, nine, or ten individual bores. Each individual bore of the one or more first bores 1072 and the one or more second bores 1074 can be spaced vertically along the second vertical side flange 1054 and the second vertical end flange 1070, respectively. The one or more first bores 1072 and the one or more second bores 1074 can be formed in corresponding positions relative to one another, such that each individual bore of the one or more first bores 1072 can be vertically and laterally aligned with each individual bore of the one or more second bores 1074, such when the second side member 1020 and the second end member 1016 are positioned with respect to the planar base member 1012.

The modular well cellar system 1000 can include a first plurality of fasteners 1076. The first plurality of fasteners 1076 can include, for example, but not limited to, threaded bolts with corresponding threaded nut, screws, rivets, or other types of fasteners. The first plurality of fasteners 1076 can secure any of the first vertical side flange 1048 to the first vertical end flange 1064, the second vertical side flange 1050 to the first vertical end flange 1068, the first vertical side flange 1052 to the second vertical end flange 1066, or the second vertical side flange 1054 to the second vertical end flange 1070, such as by extending through, or otherwise engaging, the one or more first bores 1072 and the one or more second bores 1074 concurrently.

In a non-limiting example, the first plurality of fasteners 1076 can be threaded fasteners, and the one or more second bores 1074 can be threaded bores configured to threadedly engage a threaded portion of each individual fastener of the first plurality of fasteners 1076. In such an example, each individual fastener of the first plurality of fasteners 1076 can be passed through each individual bore of the one or more first bores 1072 to threadedly engage each individual bore of the one or more second bores 1074. In one non-limiting example, the one or more first bores 1072 can be non-threaded and the first plurality of fasteners 1076 can include bolts with nuts.

In one non-limiting example, the one or more first bores 1072 can be non-threaded and the first plurality of fasteners 1076 can include bolts where nuts or other threaded elements are secured (e.g., welded) on a back side or a front side of an opposing respective flange, such as any of the first vertical side flange 1048, first vertical end flange 1064, the second vertical side flange 1050, the first vertical end flange 1068, the first vertical side flange 1052, the second vertical end flange 1066, the second vertical side flange 1054, or the second vertical end flange 1070. Where a nut is positioned on a front side of a flange, the nut can fall within a joint formed between two opposing flanges to act as a non-compressible spacer, such as one of the plurality of spacers 1122 described below, between the opposing flanges.

The first side member 1018 can include a horizontal side flange 1078 and the second side member 1020 can include a horizontal side flange 1080. The horizontal side flange 1078 of the first side member 1018, and the horizontal side flange 1080 of the second side member 1020, can be, for example, but not limited to, a bent portion of the first side member 1018 or the second side member 1020, segments of flat bar stock, or angle iron fixedly coupled to the first side member 1018 and the second side member 1020, respectively. The horizontal side flange 1078 can extend laterally inwardly from the planar portion 1044 between the first end 1056 and the second end 1058 of the first side member 1018; and the horizontal side flange 1080 can extend laterally inwardly from the planar portion 1046 between the first end 1060 and the second end 1062 of the second side member 1020.

The first end member 1014 can include a horizontal end flange 1082 and the second end member 1016 can include a horizontal end flange 1084. The horizontal end flange 1082 of the first end member 1014, and the horizontal end flange 1084 of the second end member 1016, can be, for example, but not limited to, a bent portion of the first end member 1014 or the second end member 1016, segments of flat bar stock, or angle iron fixedly coupled to the first end member 1014 and the second end member 1016, respectively. The horizontal end flange 1082 of the first end member 1014 can extend laterally inwardly from the first planar portion 1032 and the second planar portion 1034, and longitudinally inwardly from the third planar portion 1036. The horizontal end flange 1084 of the second end member 1016 can extend laterally inwardly from the first planar portion 1038 and the second planar portion 1040, and longitudinally inwardly from the third planar portion 1042. For example, the horizontal end flange 1082 of the first end member 1014 and the horizontal end flange 1084 of the second end member 1016, can be U-shaped, such as shown in FIG. 2.

The horizontal side flange 1078 of the first side member 1018, the horizontal side flange 1080 of the second side member 1020, the horizontal end flange 1082 of the first end member 1014, and the horizontal end flange 1084 of the second end member 1016 can enable each of the first end member 1014, the second end member 1016, the first side member 1018, and the second side member 1020 to be secured to the planar base member 1012. For example, the horizontal side flange 1080 of the second side member 1020 can define one or more first bores 1086 and the planar base member 1012 can define one or more second bores 1088 (also shown in FIG. 4A). For the sake of brevity, the one or more first bores 1086 is discussed below with reference to the horizontal side flange 1080 of the second side member 1020 and the one or more second bores 1088 is discussed below with reference to the planar base member 1012. However, the horizontal end flanges can each define the one or more second bores 1088.

The one or more first bores 1086 can extend longitudinally through the horizontal side flange 1080 and the one or more second bores 1088 can extend vertically through the planar base member 1012. The one or more first bores 1086 or the one or more second bores 1088 can be threaded, such as by including threaded inserts. The one or more first bores 1086 can each define, for example, but not limited to, two, three, five, six, seven, eight, nine, or ten individual bores. The one or more second bores 1088 can define, for example, but not limited to, a number of individual bores proportional to the number of individual bores that the one or more first bores 1086 defines, and the number walls (e.g., side members or end members) that the modular well cellar system 1000 includes. For example, if the one or more first bores 1086 defines ten individual bores and the modular well cellar system 1000 includes four walls (e.g., the first end member 1014, the second end member 1016, the first side member 1018, and the second side member 1020), then the one or more second bores 1088 can define forty individual bores.

Each individual bore of the one or more first bores 1086, and each individual bore of the one or more second bores 1088, can be spaced apart from one another along the horizontal side flange 1080 and the planar base member 1012, respectively. The one or more first bores 1086 and the one or more second bores 1088 can be formed in. corresponding positions relative to one another, such that each individual bore of the one or more first bores 1086 can be laterally and longitudinally aligned with each individual bore of the one or more second bores 1088, such when the second side member 1020 is positioned with respect to the planar base member 1012. The modular well cellar system 1000 can include a second plurality of fasteners 1090. The second plurality of fasteners 1090 can include, for example, but not limited to, threaded bolts with corresponding threaded nut, screws, rivets, or other types of fasteners.

The second plurality of fasteners 1090 can secure the horizontal side flange 1078 of the first side member 1018, the horizontal side flange 1080 of the second side member 1020, the horizontal end flange 1082 of the first end member 1014, and the horizontal end flange 1084 of the second end member 1016 to the planar base member 1012, such as by extending through, or otherwise engaging, the one or more first bores 1086 and the one or more second bores 1088 concurrently. In a non-limiting example, the second plurality of fasteners 1090 can be threaded fasteners, and the one or more second bores 1088 can be threaded bores configured to threadedly engage a threaded portion of each individual fastener of the second plurality of fasteners 1090. In such an example, each individual fastener of the second plurality of fasteners 1090 can be passed through each individual bore of the one or more first bores 1086 to threadedly engage each individual bore of the one or more second bores 1088. In other non-limiting examples, the second plurality of fasteners 1090 can be similar or different to the first plurality of fasteners 1076.

In one non-limiting example, the one or more first bores 1086 can be non-threaded and the second plurality of fasteners 1090 can include bolts with nuts. In one non-limiting example, the one or more first bores 1086 can be non-threaded and the second plurality of fasteners 1090 can include bolts where nuts or other threaded elements are secured (e.g., welded) on a back side or a front side of an opposing respective flange, such as any of the horizontal side flange 1078 of the first side member 1018, the horizontal side flange 1080 of the second side member 1020, the horizontal end flange 1082 of the first end member 1014, the horizontal end flange 1084 of the second end member 1016, or the planar base member 1012. Where a nut is positioned on a front side of a flange, the nut can fall within a joint formed between two opposing flanges to act as a non-compressible spacer, such as one of the plurality of spacers 1122 described below, between the opposing flanges.

The modular well cellar system 1000, including any of various components thereof such as the first end member 1014, the second end member 1016, the first side member 1018, and the second side member 1020 can be made from, but not limited to painted, galvanized, or otherwise treated or untreated flat or corrugated sheet metal. While the modular well cellar system 1000 shown in, and described with regard to FIGS. 1-2 above, includes four walls (e.g., the first end member 1014, the second end member 1016, the first side member 1018, and the second side member 1020), the modular well cellar system 1000 can include other numbers of walls. In one alternative non-limiting example, the modular well cellar system 1000 can include three walls, such as by including a first side member, a second side member, a planar first end member, and a triangular planar base member. In another alternative non-limiting example, the modular well cellar system 1000 can include five walls, such as by including a first side member, a second side member, a third side member, a planar first end member, a planar second end member, and a pentagonal planar base member. In a further non-limiting example, the modular well cellar system 1000 can include a single curved (e.g., circular shaped) wall, such as by including a first semi-circular end member, a second semi-circular end member, and a circular planar base member.

FIG. 3A illustrates a modular well cellar system 1000 in an assembled state. FIG. 3B illustrates a modular well cellar system 1000 in a disassembled state. FIGS. 3A-3B are discussed below concurrently, with reference to the modular well cellar system 1000 shown in, and described with regard to, FIGS. 1-2 above. In a non-limiting example, such as in an example where the modular well cellar system 1000 includes four walls, the modular well cellar system 1000 can include a first seal 1100 (FIG. 3A), a second seal 1102 (FIG. 3A), a third seal 1104 (FIG. 3A), a fourth seal 1106 (FIG. 3A), and a fifth seal 1108 (FIG. 3A).

The first seal 1100 can be formed between the planar base member 1012 (FIG. 3B) and each of the first end member 1014, the second end member 1016, the first side member 1018, and the second side member 1020. To form the first seal 1100, a sealing material, such as an elastomeric solid gasket material, or an elastomeric liquid sealing material, can be deposited along, or affixed to, a portion of the top surface 1021 (FIG. 3B) of the planar base member 1012. For example, a portion of the planar base member 1012 aligned with the horizontal side flange 1078 (FIG. 2) of the first side member 1018, the horizontal side flange 1080 (FIG. 3B) of the second side member 1020, the horizontal end flange 1082 (FIG. 3B) of the first end member 1014, and the horizontal end flange 1084 (FIG. 3B) of the second end member 1016 can receive the sealing material. The first end member 1014, the second end member 1016, the first side member 1018, and the second side member 1020 can then be secured to the planar base member 1012 to establish the first seal 1100 therebetween.

The second seal 1102 can be formed between the first end member 1014 and the first side member 1018. To form the second seal 1102, a sealing material, such as an elastomeric solid gasket material, or an elastomeric liquid sealing material, can be deposited along, or affixed to, the first vertical side flange 1048 (FIG. 3B) of the first side member 1018 or the first vertical end flange 1064 (FIG. 3B) of the first end member 1014. The first side member 1018 can then be secured to the first end member 1014 to establish the second seal 1102 therebetween. The third seal 1104 can be formed between the first end member 1014 and the second side member 1020. To form the third seal 1104, a sealing material, such as an elastomeric solid gasket material, or an elastomeric liquid sealing material, can be deposited along, or affixed to, the first vertical side flange 1052 (FIG. 3B) of the second side member 1020 or the second vertical end flange 1066 (FIG. 3B) of the first end member 1014. The second side member 1020 can then be secured to the first end member 1014 to establish the third seal 1104 therebetween.

The fourth seal 1106 can be formed between the second end member 1016 and the first side member 1018. To form the fourth seal 1106, a sealing material, such as an elastomeric solid gasket material, or an elastomeric liquid sealing material, can be deposited along, or affixed to, the second vertical side flange 1050 (FIG. 3B) of the first side member 1018 or the first vertical end flange 1068 (FIG. 3B) of the second end member 1016. The first side member 1018 can then be secured to the second end member 1016 to establish the fourth seal 1106 therebetween. The fifth seal 1108 can be formed between second end member 1016 and the second side member 1020. To form the fifth seal 1108, a sealing material, such as an elastomeric solid gasket material, or an elastomeric liquid sealing material, can be deposited along, or affixed to, the second vertical side flange 1054 (FIG. 3B) of the second side member 1020 or the second vertical end flange 1070 (FIG. 3B) of the second end member 1016. The second side member 1020 can then be secured to the second end member 1016 to establish the fifth seal 1108 therebetween.

As shown in FIG. 3B, the modular well cellar system 1000 can be positioned in a flat-pack arrangement. When in the flat-pack arrangement, the second side member 1020 can be stacked onto the first side member 1018, or vice versa, and the planar base member 1012 can be stacked onto the second side member 1020, such that the planar portion 1044 of the first side member 1018, the planar portion 1046 of the second side member 1020, and the top surface 1021 of the planar base member 1012 extend parallel or one another. The first end member 1014 and the second end member 1016 can each be stacked onto the top surface 1021 of the planar base member 1012, such that the third planar portion 1036 of the first end member 1014, the third planar portion 1042 of the second end member 1016, and the top surface 1021 of the planar base member 1012 extend parallel to one another.

In view of the above, an overall height of the modular well cellar system 1000 in the disassembled state can be significantly less that the overall height of the modular well cellar system 1000 in the assembled state shown in FIG. 3A. This can reduce the shipping cost of shipping the modular well cellar system 1000; and enable the modular well cellar system 1000 to be transported on smaller or lighter vehicles, relative to a vehicle configured to transport a monolithic or fixedly assembled containment well cellar, such vehicles configured to access remote drilling locations.

Further, an overall length of the modular well cellar system 1000 can be varied by virtue of the modular nature of the modular well cellar system 1000. For example, the modular well cellar system 1000 can include a third side member and a fourth side member stacked beneath the first side member 1018, or the second side member 1020, when in the disassembled state. In such an example, when in the assembled state, the third side member can be secured to the first side member 1018 and the second end member 1016 and the fourth member can be secured to the second side member 1020 and the second end member 1016; and the planar base member 1012 can be configured to accommodate the additional length provided by the third side member and the fourth side member, such as by sizing the first longitudinal surface 1024 (FIG. 2) and the second longitudinal surface 1026 (FIG. 5) to correspond to a longitudinal length defined by the first side member 1018, the third side member, and the first planar portion 1032 of the first end member 1014.

Figure 4B:
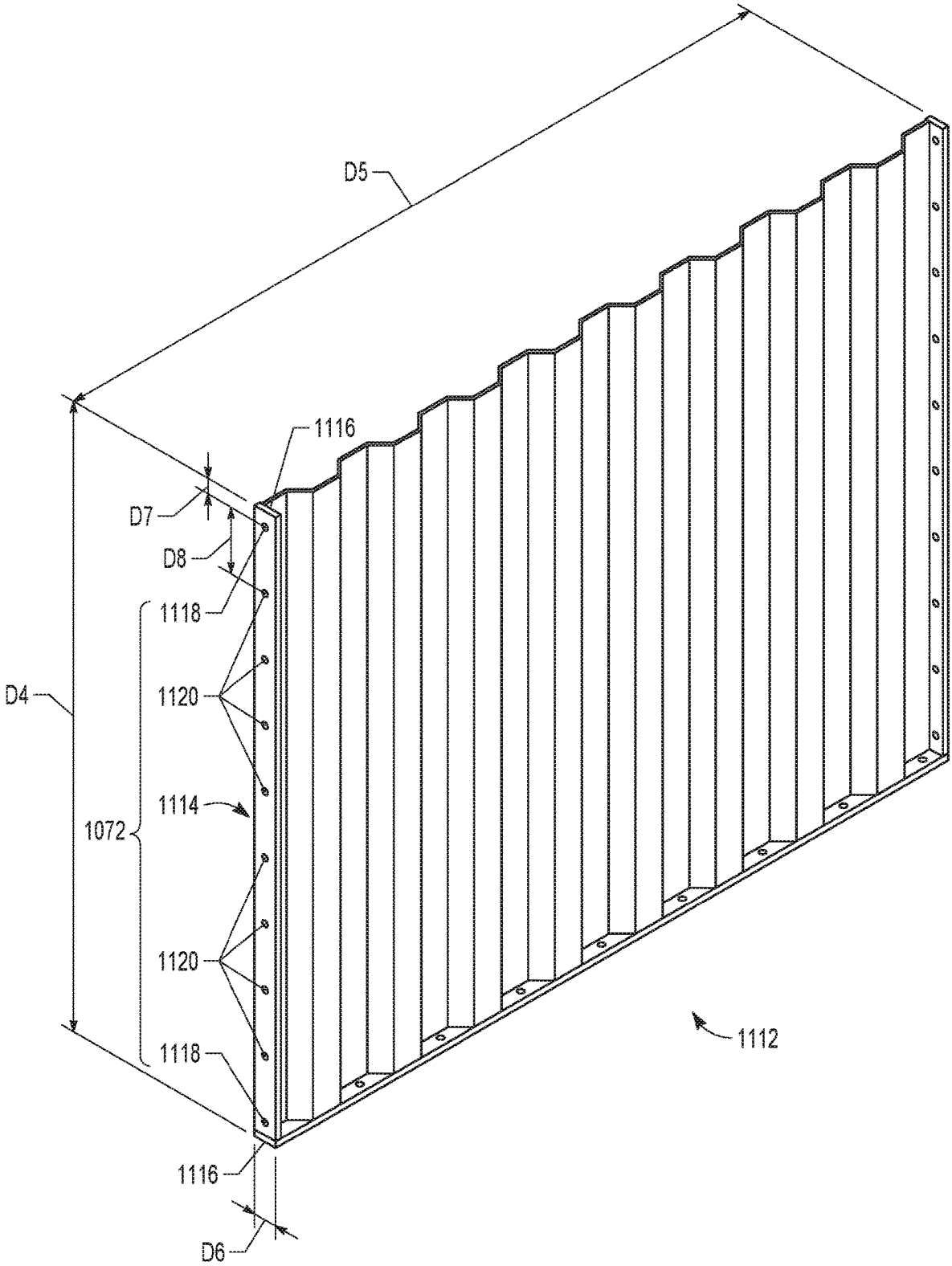
FIG. 4B illustrates an isometric view of an example side member.

FIG. 4A illustrates an isometric view of an example end member 1110. FIG. 4B illustrates an isometric view of an example side member 1112. FIGS. 4A-4B are discussed below concurrently with reference to the modular well cellar system 1000 shown in, and described with regard to, FIGS. 1-3B above. Regarding FIG. 4A, the end member 1110 shown in FIG. 4A can be the first end member 1014 (FIGS. 1-3B) or the second end member 1016 (FIGS. 1-3B). The end member 1110 can define a first distance D1, a second distance D2, and a third distance D3.

The first distance D1 can represent an overall height of the end member 1110. The first distance D1 can measure between, but is not limited to, about 80 inches to about 100 inches. In one non-limiting example, the first distance D1 can measure about 94.75 inches. The second distance D2 can represent an overall length of the end member 1110. The second distance D2 can measure between, but is not limited to, about 10 inches to about 20 inches. In one non-limiting example, the second distance D2 can measure about 16.35 inches. The third distance D3 can represent an overall width of the end member 1110. The third distance D3 can measure about between, but is not limited to, about 60 inches to about 80 inches. In one non-limiting example, the third distance D3 can measure about 73 inches.

Regarding FIG. 4B, the side member 1112 can be the first side member 1018 (FIGS. 1-3B) or the second side member 1020 (FIGS, 1-3B). The side member 1112 can include a vertical side flange 1114. The vertical side flange 1114 can represent any of the first vertical side flange 1048 (FIGS. 2 & 3B), the second vertical side flange 1050 (FIG. 2), the first vertical side flange 1052 (FIGS. 2 & 3B), or the second vertical side flange 1054 (FIGS. 2 & 3B). The side member 1112 can define a fourth distance D4, a fifth distance D5, a sixth distance D6, a seventh distance D7, and an eighth distance D8. The fourth distance D4 can represent an overall height of the side member 1112.

The fourth distance D4 can measure between, but is not limited to, about 80 inches to about 100 inches. In one non-limiting example, the fourth distance D4 can measure about 94.75 inches, The fifth distance D5 can represent an overall length of the side member 1112. The fifth distance D5 can measure about, but is not limited to, 116.88 inches. The sixth distance D6 can represent an overall width of the side member 1112. The sixth distance D6 can measure between, but is not limited to, about 2 inches to about inches. In one non-limiting example, the sixth distance D6 can measure 3.5 inches.

The seventh distance D7 and the eighth distance D8 can be dictated by the one or more first bores 1072 (also shown in FIG. 2) defined in the vertical side flange 1114. The vertical side flange 1114 can define ends 1116; and the one or more first bores 1072 can include first bores 1118 and second bores 1120. The seventh distance D7 can be a vertical distance between one of the ends 1116 of the vertical side flange 1114 and one of the first bores 1118. The first bores 1118 can be individual bores located adjacently, or otherwise most-proximally, to the ends 1116. The seventh distance D7 can measure between, but not limited to, about 1 inch to about 5 inches. In one non-limiting example, the seventh distance D7 can measure about 2.5 inches.

The eighth distance D8 can be a vertical distance between the second bores 1120 and the first bores 1118. The second bores 1120 can be adjacently located to the first bores 1118, such as on an opposite side of the first bores 1118 relative to the ends 1116 of the vertical side flange 1114. Each of the second bores 1120 can be spaced equidistantly apart relative to one another along the vertical side flange 1114, such as by the eighth distance D8. The eighth distance D8 can measure between, but is not limited to, about 8 inches to about 12 inches. In one non-limiting example, the eight distance D8 can measure about 9.97 inches.

The one or more first bores 1074 (FIG. 2) defined in the first vertical end flange 1064 (FIG. 2) and the second vertical end flange 1066 (FIG. 2) of the first end member 1014, and the first vertical end flange 1068 (FIG. 2) and the second vertical end flange 1070 (FIG. 2) of the second end member 1016 can also define the seventh distance D7 and the eight distance D8, such as to enable each individual bore of the one or more first bores 1072 to be vertically and laterally aligned with each individual bore of the one or more second bores 1074, such as when the first end member 1014 (FIG.

2) and the second end member 1016 (FIG. 2) are secured to the first side member 1018 (FIG. 2) and the second side member 1020 (FIG. 2).

Figure 5:
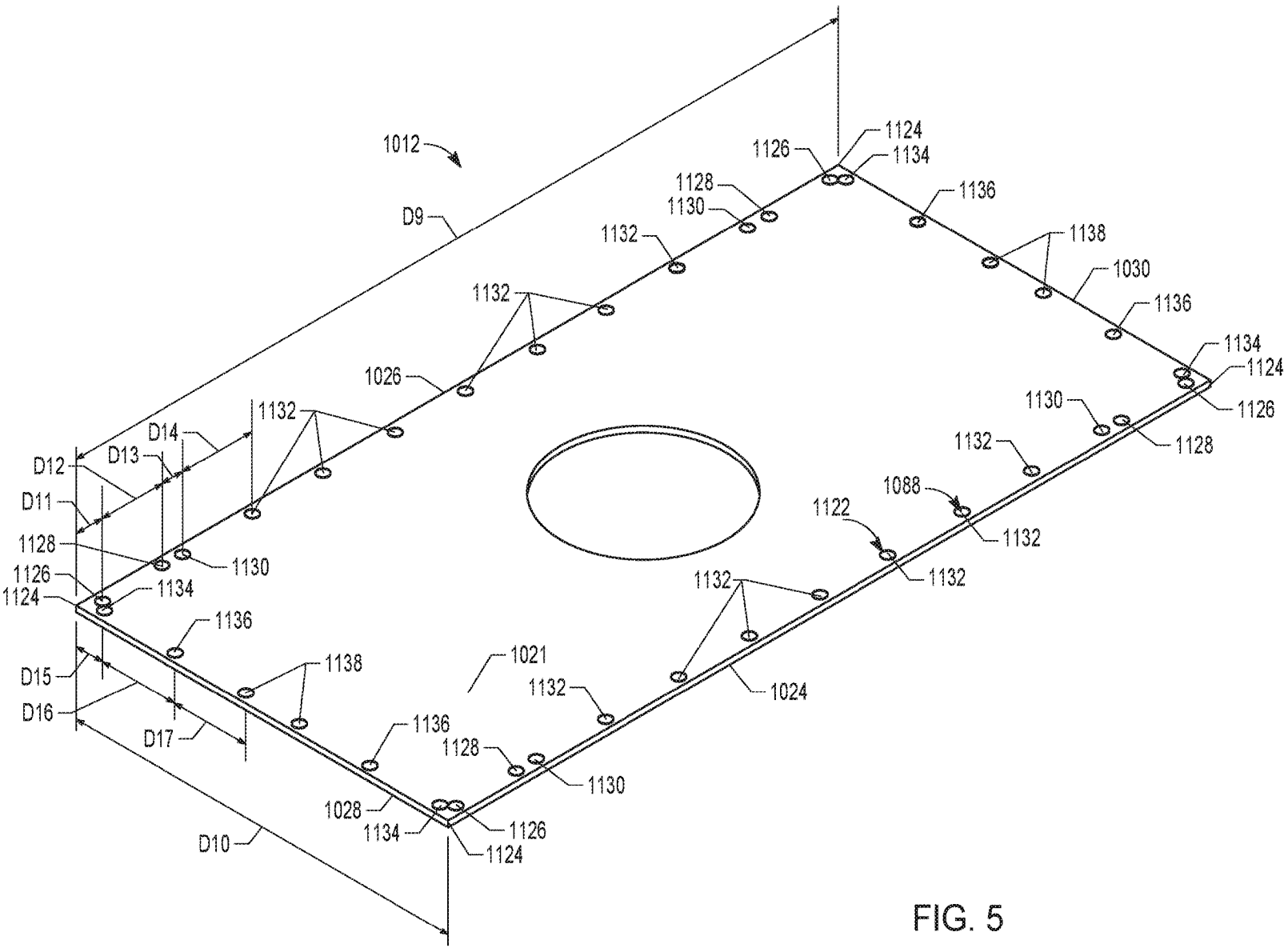
FIG. 5 illustrates an isometric view of an example planar base member.

FIG. 5 illustrates an isometric view of an example planar base member 1012. FIG. 5 is discussed below concurrently with reference to the modular well cellar system 1000 shown in, and described with regard to, FIGS. 1-4B above. The modular well cellar system 1000 can include a plurality of spacers 1122. The plurality of spacers 1122 can be non-compressible spacers, such as, but not limited to, rectangular, square, or circular washers, bushings, nuts, or other types of spacers. In one non-limiting example, the plurality of spacers 1122 can be positioned on, or affixed to, the top surface 1021 of the planar base member 1012. In another non-limiting example, the plurality of spacers 1122 can be threaded weld washers welded to the planar base member 1012.

An individual spacer of the plurality of spacers 1122 can be positioned concentrically between each individual bore of the one or more second bores 1088 defined in the planar base member 1012 and each individual bore of the one or more first bores 1086 (FIG. 2). This can enable each individual fastener of the second plurality of fasteners 1090 (FIG. 2) to extend through an individual bore of the one or more first bores 1086 and a spacer of the plurality of spacers 1122 to engage an individual bore of the one or more second bores 1088. The plurality of spacers 1122 can thereby separate the top surface 1021 of the planar base member 1012 from the horizontal end flange 1082 (FIG. 2) of the first end member 1014 (FIG. 2), the horizontal end flange 1084 (FIG. 2) of the second end member 1016 (FIG. 2), the horizontal side flange 1078 (FIG. 2) of first side member 1018 (FIG. 2), and the horizontal side flange 1080 (FIG. 2) of the second side member 1020 (FIG. 2), when the planar base member 1012 is secured to the first end member 1014, the second end member 1016, the first side member 1018, and the second side member 1020.

Similarly, an individual spacer of the plurality of spacers 1122 can be positioned concentrically between each individual bore of the one or more first bores 1072, such as defined in any of the first vertical end flange 1064 (FIG. 2), the second vertical end flange 1066 (FIG. 2), the first vertical end flange 1068 (FIG. 2), or the second vertical end flange 1070 (FIG. 2). This can enable each individual fastener of the first plurality of fasteners 1076 (FIG. 2) to extend through an individual bore of the one or more first bores 1072 and a spacer of the plurality of spacers 1122 to engage an individual bore of the one or more second bores 1074.

The plurality of spacers 1122 can thereby separate the first vertical side flange 1048 (FIG. 2) from the first vertical end flange 1064, the second vertical side flange 1050 (FIG. 2) from the first vertical end flange 1068, the second vertical side flange 1054 (FIG. 2) from the second vertical end flange 1070, and the first vertical side flange 1052 (FIG. 2) from the second vertical end flange 1066 when the first end member 1014 and the second end member 1016 are secured to the first side member 1018 and the second side member 1020. The first seal 1100 (FIG. 3A), the second seal 1102 (FIG. 3A), the third seal 1104 (FIG. 3A), the fourth seal 1106 (FIG. 3A), and the fifth seal 1108 (FIG. 3A) can encompass the plurality of spacers 1122. In one non-limiting example, the plurality of spacers 1122 can be molded into, or can otherwise be integrally formed with, a solid gasket material from which any of the first seal 1100, the second seal 1102, the third seal 1104, the fourth seal 1106, or the fifth seal 1108 is made from. The plurality of spacers 1122 can help to improve the structural rigidity and fluid-tight functionality of the modular well cellar system 1000. First, for example, the non-compressible nature of the plurality of spacers 1122 can enable any of the first end member 1014, the second end member 1016, the first side member 1018, the second side member 1020, or the planar base member 1012 to be rigidly coupled to one another, such as to help minimize flex or deflection therebetween as a result of forces applied to the modular well cellar system 1000 by a drilling rig or other equipment.

Second, the plurality of spacers 1122 can reduce the compression force that the first seal 1100, the second seal 1102, the third seal 1104, the fourth seal 1106, or the fifth seal 1108 are subject to. This can help to slow decay of the gasket material comprising the first seal 1100, the second seal 1102, the third seal 1104, the fourth seal 1106, or the fifth seal 1108, while preventing decay of the gasket material from the compression force between the first end member 1014, the second end member 1016, the first side member 1018, the second side member 1020, or the planar base member 1012.

The planar base member 1012 can define a ninth distance D9, a tenth distance D10, an eleventh distance D11, a twelfth distance D12, a thirteenth distance D13, a fourteenth distance D14, and a fifteenth distance D15, a sixteenth distance D16, and a seventeenth distance D17. The ninth distance D9 can represent an overall length of the planar base member 1012, such as defined by the first longitudinal surface 1024 or the second longitudinal surface 1026. The ninth distance D9 can measure between, but not limited to, about 130 inches to about 160 inches. In one non-limiting example, the ninth distance D9 can measure about 149.78 inches. The tenth distance D10 can represent an overall width of the planar base member 1012, such as defined by the first lateral surface 1028. The tenth distance D10 can measure between, but is not limited to, about 65 inches to about 75 inches. In one non-limiting example, the tenth distance D10 can measure about 73 inches.

The one or more second bores 1088 can dictate the eleventh distance D11, the twelfth distance D12, the thirteenth distance D13, the fourteenth distance D14, the fifteenth distance D15, the sixteenth distance D16, and the seventeenth distance D17. The one or more second bores 1088 can include first bores 1126, second bores 1128, third bores 1130, fourth bores 1132, fifth bores 1134, and sixth bores 1136. The eleventh distance D11 can be a longitudinal distance between a corner 1124 of the planar base member 1012 and the first bores 1126. The first bores 1126 can be individual bores located adjacently, or otherwise most-proximally, to both a corner 1124, and the second longitudinal surface 1026 or the first longitudinal surface 1024. The eleventh distance D11 can measure between, but is not limited to, about 2 inches to about 5 inches. In one non-limiting example, the eleventh distance D11 can measure 3.13 inches. The twelfth distance D12 can be a longitudinal distance between the second bores 1128 and the first bores 1126. The second bores 1128 can be adjacently located to the first bores 1126, such as on an opposite side of the first bores 1126 relative to a corner 1124. The twelfth distance D12 can measure between, but is not limited to, about 10 inches to about 15 inches. In one non-limiting example, the twelfth distance D12 can measure about 12 inches.

The thirteenth distance D13 can be a longitudinal distance between the second bores 1128 and the third bores 1130. The third bores 1130 can be adjacently located to the second bores 1128, such as on an opposite side of the second bores 1128 relative to the first bores 1126. The thirteenth distance D13 can measure between, but is not limited to, between about 2 inches and about 6 inches. In one non-limiting example, the thirteenth distance D13 can measure about 3.76 inches. The fourteenth distance D14 can be a longitudinal distance between the third bores 1130 and the fourth bores 1132. The fourth bores 1132 can be adjacently located to the third bores 1130, such as on an opposite side of the third bores 1130 relative to the second bores 1128. Each of the fourth bores 1132 along the first longitudinal surface 1024 and the second longitudinal surface 1026 can be spaced equidistantly apart relative to one another, such as by a distance equal to the fourteenth distance D14. The fourteenth distance D14 can measure between, but is not limited to, about 12 inches to about 16 inches. In one non-limiting example, the fourteenth distance D14 can measure about 14 inches.

The fifteenth distance D15 can be a lateral distance between a fifth bore 1134 of the one or more second bores 1088 and the corner 1124 of the planar base member 1012. The fifth bore 1134 can be an individual bore of the one or more second bores 1088 located adjacently, or otherwise most-proximally, to a corner 1124 and the first lateral surface 1028 or the second lateral surface 1030. The fifteenth distance D15 can measure between, but is not limited to, about 2 inches to about 5 inches, In one non-limiting example, the fifteenth distance D15 can measure 3.13 inches. The sixteenth distance D16 can represent a lateral distance between the fifth bores 1134 and the sixth bores 1136. The sixth bores 1136 can be adjacently located to the fifth bores 1134, such as on an opposite side of the fifth bores 1134 relative to a corner 1124. The sixteenth distance D16 can measure between, but is not limited to, about 12 inches to about 16 inches. In one non-limiting example, the sixteenth distance D16 can measure about 14 inches.

The seventeenth distance D17 can represent a lateral distance between the sixth bores 1136 and the seventh bores 1138. The seventh bores 1138 can be adjacently located to the sixth bores 1136, such as on an opposite side of the sixth bores 1136 relative to the fifth bores 1134. Each of the seventh bores 1138 along the first lateral surface 1028 and the second lateral surface 1030 can be spaced equidistantly apart relative to one another, such as by a distance equal to the seventeenth distance D17. The seventeenth distance D17 can measure between, but is not limited to, about 8 inches to about 12 inches. In one non-limiting example, the seventeenth distance D17 can measure about 10.74 inches.

The one or more first bores 1086 defined in any of the horizontal end flange 1082 of the first end member 1014, the horizontal end flange 1084 of the second end member 1016, the horizontal side flange 1078 of the first side member 1018, or the horizontal side flange 1080 of the second side member 1020 can also define the eleventh distance D11, the twelfth distance D12, the thirteenth distance D13, the fourteenth distance D14, the fifteenth distance D15, the sixteenth distance D16, and the seventeenth distance D17. This can enable each individual bore of the one or more first bores 1086 to be laterally and longitudinally aligned with each individual bore of the one or more second bores 1088, such when the first end member 1014, the second end member 1016, the first side member 1018, and the second side member 1020 are secured to the planar base member 1012.

Figure 6:
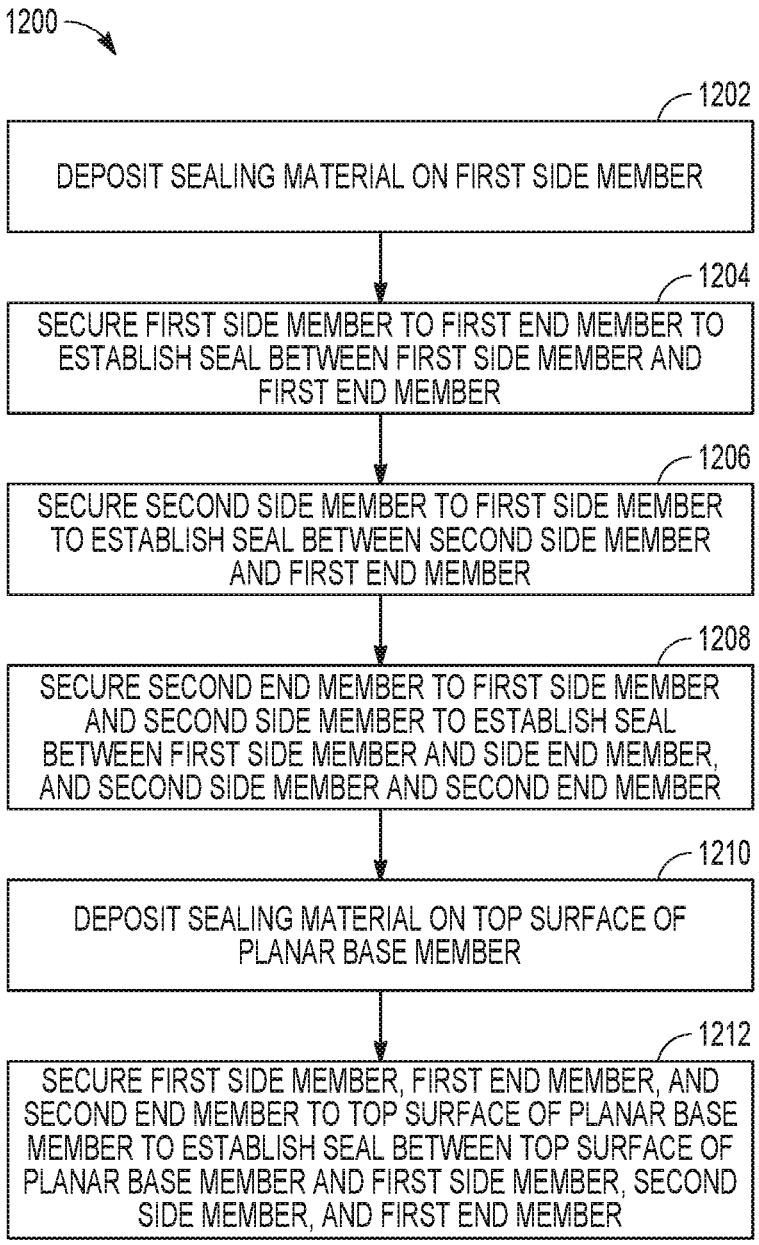
FIG. 6 illustrates an example method of assembling a modular well cellar system.

FIG. 6 illustrates an example method 1200 of assembling a modular well cellar system. Any of the above examples of the modular well cellar system 1000 shown in, and described with regard to, FIGS. 1-5B above can be used in the method 1200 of assembling a modular well cellar system. The discussed steps or operations can be performed in parallel or in a different sequence without materially impacting other operations. The method 1200 as discussed includes operations that can be performed by multiple different actors, devices, and/or systems. It is understood that subsets of the operations discussed in the method 1200 can be attributable to a single actor device, or system, and could be considered a separate standalone process or method.

The method 1200 can include operation 1202. The operation 1202 can include depositing a sealing material on a first side member. For example, a liquid gasket material can be deposited along a first vertical side flange and a second vertical side flange of the first side member, or a solid gasket can be affixed to the first vertical side flange and the second vertical side flange of the first side member. In a non-limiting example, the operation 1202 can include positioning the planar base member below grade within a well cellar excavation. For example, the planar base member can be positioned on a subterranean ground surface located below ground level within a well cellar excavation, such as to form a floor surface of the modular well cellar system.

The method 1200 can include operation 1204. The operation 1204 can include securing a first end member to the first side member to establish a seal between the first side member and the first end member. For example, once the sealing material is present on a first vertical side flange of the first side member, the first vertical side flange of the first side member can be coupled to a first vertical end flange of the first end member. The sealing material can form a liquid-tight seal between the first vertical side flange of the first side member and the first vertical end flange of the first end member.

The method 1200 can include operation 1206. The operation 1206 can include securing a second side member to the first end member to establish a seal between the second side member and the first end member. For example, once the sealing material is present on a first vertical side flange of the second side member, the first vertical side flange of the second side member can be coupled to a second vertical end flange of the first end member. The sealing material can form a liquid-tight seal between the first vertical side flange of the second side member and the second vertical end flange of the first end member.

In a non-limiting example, the operation 1206 can include threadedly engaging a plurality of threaded bores defined in the planar base member with a plurality of threaded fasteners extending through the first side member, the second side member, the first side member, or the second end member. For example, each fastener of the plurality of fasteners can be first be passed through a bore, such as defined in the first vertical side flange of the first side member and first vertical side flange of the second side member. Each fastener of plurality of fasteners can then be rotated, such as in a clockwise direction, to cause a threaded portion of each faster to engage a plurality of threads defined by each of the threaded bores, such as defined by the first vertical end flange or the second vertical end flange of the first end member.

In a non-limiting example, the operation 1206 can include passing each threaded fastener of the plurality of threaded fasteners through a non-compressible spacer. For example, each fastener of the plurality of fasteners can be first be passed longitudinally through a bore, such as defined in the first vertical side flange of the first side member and first vertical side flange of the second side member, and then longitudinally through a spacer, such as located between the first vertical side flange of the first side member or the first vertical side flange of the second side member and the planar base member, or between the first vertical end flange of the first end member, or the second vertical end flange of the first end member, and the planar base member.

In some examples, the method 1200 can optionally include operation 1208. The operation 1208 can include securing the first side member to a second end member to establish a seal between the first side member and the second end member, wherein the seal between the first side member and the second end member is longitudinally offset from a corner of the planar base member; and securing the second side member to the second end member to establish a seal between the second side member and the second end member, wherein the seal between the second side member and the second end member is longitudinally offset from a corner of the planar base member.

For example, once the sealing material is present on the second vertical side flange of the first side member and the second vertical side flange of the second side member, the second vertical side flange of the first side member can be coupled to a first vertical end flange of the second side member and the second vertical side flange of the second side member can be coupled to a second vertical end flange of the second end member. The sealing material can form a liquid-tight seal between the second vertical side flange of the first side member and the first vertical end flange of the second end member, and the second vertical side flange of the second side member and the second vertical end flange of the second end member.

The method 1200 can include operation 1210. The operation 1210 can include depositing a sealing material on a top surface of a planar base member. For example, a liquid gasket material can be deposited along a portion of the top surface located to be in contact with a horizontal side flange of the first side member and the second side member, and a horizontal end flange of the first end member and the second end member.

The method 1200 can include operation 1212. The operation 1212 can include securing the first side member, the second side member, and the first end member to the top surface of the planar base member to establish a seal between the planar base member and the first side member, the second side member, and the first end member, wherein the seal between the first side member and the first end member and the seal between the second side member and the first end member is longitudinally offset from a corner of the planar base member.

For example, once the sealing material is present on the top surface of the planar base member, the horizontal side flange of the first side member and the second side member, and the horizontal end flange and the first end member can be coupled to the planar base member. The sealing material can form a liquid-tight seal between the top surface of the planar base member and each of the horizontal side flange of the first side member and the second side member, and the horizontal end flange and the first end member. Additionally, the first end member can be U-shaped, such as to enable the seal between the first vertical end flange and the first vertical side flange of the first side member, and the seal between the second vertical end flange and the first vertical side flange of the second side member to be located in a position longitudinally offset from a corner of the planar base member.

In a non-limiting example, the operation 1212 can include securing the second end member to the top surface of the planar base member to establish a seal between the second end member and the top surface. For example, once the sealing material is present on the top surface of the planar base member, a horizontal end flange of the second end member can be coupled to the planar base member. The sealing material can form a liquid-tight seal between the top surface of the planar base member and horizontal flange of the second end member.

In a non-limiting example, the operation 1212 can include threadedly engaging a plurality of threaded bores defined in the planar base member with a plurality of threaded fasteners extending through the first side member, the second side member, the first side member, or the second end member. For example, each fastener of the plurality of fasteners can be first be passed through a bore, such as defined in the horizontal side flange of the first side member and the second side member, and the horizontal end flange of the first end member. Each fastener of plurality of fasteners can then be rotated, such as in a clockwise direction, to cause a threaded portion of each faster to engage a plurality of threads defined by each of the threaded bores.

In a non-limiting example, the operation 1212 can include passing each threaded fastener of the plurality of threaded fasteners through a non-compressible spacer. For example, each fastener of the plurality of fasteners can be first be passed vertically through a bore, such as defined in the horizontal side flange of the first side member or the second side member, or the horizontal end flange of the first end member, and then vertically through a spacer, such as located between the horizontal side flange of the first side member or the second side member and the planar base member, or between the horizontal end flange of the first end member and the planar base member.

The foregoing systems and devices, etc. are merely illustrative of the components, interconnections, communications, functions, etc. that can be employed in carrying out examples in accordance with this disclosure. Different types and combinations of sensor or other portable electronics devices, computers including clients and servers, implants, and other systems and devices can be employed in examples according to this disclosure.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided.

Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein. In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure.

This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

EXAMPLES

The following, non-limiting examples, detail certain aspects of the present subject matter to solve the challenges and provide the benefits discussed herein, among others.

Example 1 is a modular well cellar system such as comprising: a planar base member for placement below grade in a well cellar excavation and defining an aperture sized to receive a conductor pipe; a first end member secured to the base member and configured to support a first lateral wall of the well cellar excavation; a first side member secured to the base member and the first end member, the first side member configured to support a first longitudinal wall of the well cellar excavation; and a second side member secured to the planar base member and the first end member, the second side member configured to support a second longitudinal wall of the well cellar excavation; and a seal formed between a top surface of the planar base member and each of the first end member, the first side member, and the second side member.

In Example 2, the subject matter of Example 1 includes, a second end member secured to the planar base member, the first end member, first side member, and the second side member, the second end member configured to support a second longitudinal wall of the well cellar excavation.

In Example 3, the subject matter of Example 2 includes, wherein: the first end member includes a first planar portion extending parallel to a first lateral surface of the planar base member, a second planar portion extending parallel to a first longitudinal surface of the planar base member, and a third planar portion extending parallel to a second longitudinal surface of the planar base member; and the second end member includes a first planar portion extending parallel to a second lateral surface of the planar base member, a second planar portion extending parallel to the first longitudinal surface of the planar base member, and a third planar portion extending parallel to the second longitudinal surface of the planar base member.

In Example 4, the subject matter of Example 3 includes, wherein the first side member includes a planar portion extending parallel to the first longitudinal surface of the planar base member and the second planar portion of each of the first end portion and the second end portion; and a second side member is secured to the base member, the first end member, and the second end member, the second side member configured to support a second longitudinal wall of the well cellar excavation; and wherein the second side member includes a planar portion extending parallel to the second longitudinal surface of the planar base member and the third planar portion each of the first end portion and second end portion.

In Example 5, the subject matter of Example 4 includes, wherein the first planar portion, the second planar portion, and the third planar portion of the first end member and the second end member, and the planar portion of each of the first side member and the second side member, are each formed from corrugated sheet metal.

In Example 6, the subject matter of Example 5 includes, wherein: the first end member and the second end member each include a horizontal end flange extending inwardly from the first planar portion, the second planar portion, and the third planar portion toward the aperture of the planar base member, wherein a portion of the seal is formed between the horizontal end flange and a top surface of the planar base member; and the first side member and the second side member each include a horizontal side flange extending inwardly from the planar portion toward the aperture of the planar base member, wherein a portion of the seal is formed between the horizontal side flange and the top surface of the planar base member.

In Example 7, the subject matter of Example 6 includes, wherein the horizontal end flange of each of the first end member and the second end member forms a U-shape.

In Example 8, the subject matter of Example 7 includes, wherein: the first end member and the second end member each include a first vertical end flange extending inwardly from the second planar portion toward the aperture of the planar base member and a second vertical end flange extending inwardly from the third planar portion toward the aperture of the planar base member; and the first side member and the second side member each include a first vertical side flange and a second vertical side flange extending inwardly from the planar portion toward the aperture of the planar base member, wherein the first vertical side flange is located at a first end of the planar portion and the second vertical side flange is located at a second end of the planar portion.

In Example 9, the subject matter of Example 8 includes, a second seal located between the first vertical end flange of the first end member and the first vertical side flange of the first side member; a third seal located between the second vertical end flange of the first end member and the first vertical side flange of the second side member; a fourth seal located between the first vertical end flange of the second end member and the second vertical side flange of the first side member; and a fifth seal located between the second vertical end flange of the second end member and the second vertical side flange of the second side member.

In Example 10, the subject matter of Example 9 includes, wherein: the horizontal end flange of the first end member and the second end member, and the horizontal side flange of the first side member and the second end member, are secured to the top surface of the planar base member with a first plurality of fasteners; and the first vertical end flange of the first end member is secured to the first vertical side flange of the first side member, the second vertical end flange of the first end member is secured to the first vertical side flange of the second side member, the first vertical end flange of the second end member is secured to the second vertical side flange of the first side member; and the second vertical end flange of the second end member is secured to the second vertical side flange of the second side member with a second plurality of fasteners.

In Example 11, the subject matter of Example 10 includes, a plurality of non-compressible spacers, wherein each fastener of the first plurality of fasteners and the second plurality of fasteners extends through a non-compressible spacer of the plurality of non-compressible spacers.

In Example 12, the subject matter of Example 11 includes, wherein the plurality of non-compressible spacers is fixedly attached to, and spaced laterally along, the horizontal end flange of the first end member and the second end member, the horizontal side flange of the first side member and the second side member, the first vertical end flange and the second vertical end flange of the first end member, and the first vertical end flange and the second vertical end flange of the second end member.

In Example 13, the subject matter of Examples 11-12 includes, wherein the first plurality of fasteners are threaded fasteners; and wherein the planer base member defines a plurality of threaded bores each configured to threadedly engage a fastener of the first plurality of fasteners to secure the first end member, the second end member, the first side member, and the second side member to the planar base member.

In Example 14, the subject matter of Examples 11-13 includes, wherein the first seal, the second seal, the third seal, the fourth seal, or the fifth seal, are formed from an elastomeric liquid sealing material or an elastomeric solid gasket material.

In Example 15, the subject matter of Examples 1-14 includes, a third side member secured to the base member and configured to support the first lateral wall of the well cellar excavation, the third side member connecting the first side member to the first end member; and a fourth side member secured to the base member and configured to support the first lateral wall of the well cellar excavation, the third side member connecting the first side member to the first end member.

Example 16 is a method of assembling a modular well cellar system, the method comprising: depositing a sealing material on a first side member; securing the first side member to a first end member to establish a seal between the first side member and the first end member; depositing a sealing material a second side member; securing the second side member to the first end member to establish a seal between the second side member and the first end member; depositing a sealing material on a top surface of a planar base member; and securing the first side member, the second side member, and the first end member to the top surface of the planar base member to establish a seal between the planar base member and the first side member, the second side member, and the first end member, wherein the seal between the first side member and the first end member and the seal between the second side member and the first end member is longitudinally offset from a corner of the planar base member.

In Example 17, the subject matter of Example 16 includes, wherein the method first comprises positioning the planar base member below grade within a well cellar excavation.

In Example 18, the subject matter of Examples 16-17 includes, wherein the method includes: securing the first side member to a second end member to establish a seal between the first side member and the second end member, wherein the seal between the first side member and the second end member is longitudinally offset from a corner of the planar base member; and securing the second side member to the second end member to establish a seal between the second side member and the second end member, wherein the seal between the second side member and the second end member is longitudinally offset from a corner of the planar base member; and securing the second end member to the top surface of the planar base member to establish a seal between the second end member and the top surface.

In Example 19, the subject matter of Example 18 includes, wherein securing the first side member, the second side member, the first end member, or the second end member to the top surface of the planar base member includes threadedly engaging a plurality of threaded bores defined in the planar base member with a plurality of threaded fasteners extending through the first side member, the second side member, the first side member, or the second end member.

In Example 20, the subject matter of Example 19 includes, wherein threadedly engaging the plurality of threaded bores defined in the planar base member with the plurality of threaded fasteners includes passing each threaded fastener of the plurality of threaded fasteners through a non-compressible spacer.

In Example 21, the subject matter of Example 20 includes, wherein securing the first end member to the first side member and the second side member includes threadedly engaging a plurality of threaded bores defined by the first end member with a plurality of threaded fasteners extending through the first side member and the second side member.

In Example 22, the subject matter of Example 21 includes, wherein threadedly engaging the plurality of threaded bores with the plurality of threaded fasteners includes passing each threaded fastener of the plurality of threaded fasteners through a non-compressible spacer.

Example 23 is a system to implement of any of Examples 1-22.

Example 24 is a method to implement of any of Examples 1-22.

What is claimed is:

1. A modular well cellar system comprising:

a planar base member for placement below grade in a well cellar excavation and defining an aperture sized to receive a conductor pipe;

a first end member secured to the base member and configured to support a first lateral wall of the well cellar excavation;

a first side member secured to the base member, and the first end member, the first side member configured to support a first longitudinal wall of the well cellar excavation; and a second side member secured to the planar base member and the first end member, the second side member configured to support a second longitudinal wall of the well cellar excavation; and a seal formed between a top surface of the planar base member and each of the first end member, the first side member, and the second side member;

wherein the first end member includes a first planar portion extending parallel to a first lateral surface of the planar base member, a second planar portion extending parallel to a first longitudinal surface of the planar base member, and a third planar portion extending parallel to a second longitudinal surface of the planar base member.

2. The system of claim 1, further comprising a second end member secured to: (1) the planar base member, (2) the first side member, and (3) the second side member, wherein the second end member is configured to support a second longitudinal wall of the well cellar excavation, wherein the second end member includes a first planar portion extending parallel to a second lateral surface of the planar base member, a second planar portion extending parallel to the first longitudinal surface of the planar base member, and a third planar portion extending parallel to the second longitudinal surface of the planar base member.

3. The system of claim 2, wherein the first side member includes a planar portion extending parallel to the first longitudinal surface of the planar base member and the second planar portion of each of the first end portion and the second end portion; and a second side member is secured to the base member, the first end member, and the second end member, the second side member configured to support a second longitudinal wall of the well cellar excavation; and wherein the second side member includes a planar portion extending parallel to the second longitudinal surface of the planar base member and the third planar portion each of the first end portion and second end portion.

4. The system of claim 3, wherein the first planar portion, the second planar portion, and the third planar portion of the first end member and the second end member, and the planar portion of each of the first side member and the second side member, are each formed from corrugated sheet metal.

5. The system of claim 4, wherein:

the first end member and the second end member each include a horizontal end flange extending inwardly from the first planar portion, the second planar portion, and the third planar portion toward the aperture of the planar base member, wherein a portion of the seal is formed between the horizontal end flange and a top surface of the planar base member; and the first side member and the second side member each include a horizontal side flange extending inwardly from the planar portion toward the aperture of the planar base member, wherein a portion of the seal is formed between the horizontal side flange and the top surface of the planar base member.

6. The system of claim 5, wherein the horizontal end flange of each of the first end member and the second end member forms a U-shape.

7. The system of claim 6, wherein:

the first end member and the second end member each include a first vertical end flange extending inwardly from the second planar portion toward the aperture of the planar base member and a second vertical end flange extending inwardly from the third planar portion toward the aperture of the planar base member; and the first side member and the second side member each include a first vertical side flange and a second vertical side flange extending inwardly from the planar portion toward the aperture of the planar base member, wherein the first vertical side flange is located at a first end of the planar portion and the second vertical side flange is located at a second end of the planar portion.

8. The system of claim 7, further comprising:

a second seal located between the first vertical end flange of the first end member and the first vertical side flange of the first side member;

a third seal located between the second vertical end flange of the first end member and the first vertical side flange of the second side member;

a fourth seal located between the first vertical end flange of the second end member and the second vertical side flange of the first side member; and a fifth seal located between the second vertical end flange of the second end member and the second vertical side flange of the second side member.

9. The system of claim 8, wherein:

the horizontal end flange of the first end member and the second end member, and the horizontal side flange of the first side member and the second end member, are secured to the top surface of the planar base member with a first plurality of fasteners; and the first vertical end flange of the first end member is secured to the first vertical side flange of the first side member, the second vertical end flange of the first end member is secured to the first vertical side flange of the second side member, the first vertical end flange of the second end member is secured to the second vertical side flange of the first side member; and the second vertical end flange of the second end member is secured to the second vertical side flange of the second side member with a second plurality of fasteners.

10. The system of claim 9, further comprising a plurality of non-compressible spacers, wherein each fastener of the first plurality of fasteners and the second plurality of fasteners extends through a non-compressible spacer of the plurality of non-compressible spacers.

11. The system of claim 10, wherein the plurality of non-compressible spacers is fixedly attached to, and spaced laterally along, the horizontal end flange of the first end member and the second end member, the horizontal side flange of the first side member and the second side member, the first vertical end flange and the second vertical end flange of the first end member, and the first vertical end flange and the second vertical end flange of the second end member.

12. The system of claim 10, wherein the first plurality of fasteners are threaded fasteners; and wherein the planer base member defines a plurality of threaded bores each configured to threadedly engage a fastener of the first plurality of fasteners to secure the first end member, the second end member, the first side member, and the second side member to the planar base member.

13. The system of claim 10, wherein the first seal, the second seal, the third seal, the fourth seal, or the fifth seal, are formed from an elastomeric liquid sealing material or an elastomeric solid gasket material.

14. The system of claim 1, further comprising:

a third side member secured to the base member and configured to support the first lateral wall of the well cellar excavation, the third side member connecting the first side member to the first end member; and a fourth side member secured to the base member and configured to support the first lateral wall of the well cellar excavation, the fourth side member connecting the second side member to the first end member.

15. A method of assembling a modular well cellar system, the method comprising:

depositing a sealing material on a first side member;

securing the first side member to a first end member to establish a seal between the first side member and the first end member;

depositing a sealing material a second side member;

securing the second side member to the first end member to establish a seal between the second side member and the first end member;

depositing a sealing material on a top surface of a planar base member; and securing the first side member, the second side member, and the first end member to the top surface of the planar base member to establish a seal between the planar base member and the first side member, the second side member, and the first end member, wherein the seal between the first side member and the first end member and the seal between the second side member and the first end member is longitudinally offset from a corner of the planar base member.

16. The method of claim 15, wherein the method first comprises positioning the planar base member below grade within a well cellar excavation.

17. The method of claim 15, wherein the method includes:

securing the first side member to a second end member to establish a seal between the first side member and the second end member, wherein the seal between the first side member and the second end member is longitudinally offset from a corner of the planar base member; and securing the second side member to the second end member to establish a seal between the second side member and the second end member, wherein the seal between the second side member and the second end member is longitudinally offset from a corner of the planar base member; and securing the second end member to the top surface of the planar base member to establish a seal between the second end member and the top surface.

18. The method of claim 17, wherein securing the first side member, the second side member, the first end member, or the second end member to the top surface of the planar base member includes threadedly engaging a plurality of threaded bores defined in the planar base member with a plurality of threaded fasteners extending through the first side member, the second side member, the first side member, or the second end member.

19. The method of claim 18, wherein threadedly engaging the plurality of threaded bores defined in the planar base member with the plurality of threaded fasteners includes passing each threaded fastener of the plurality of threaded fasteners through a non-compressible spacer.

20. The method of claim 19, wherein securing the first end member to the first side member and the second side member includes threadedly engaging a plurality of threaded bores defined by the first end member with a plurality of threaded fasteners extending through the first side member and the second side member.

21. The method of claim 20, wherein threadedly engaging the plurality of threaded bores with the plurality of threaded fasteners includes passing each threaded fastener of the plurality of threaded fasteners through a non-compressible spacer.

22. A modular well cellar system comprising:

a planar base member for placement below grade in a well cellar excavation and defining an aperture sized to receive a conductor pipe;

a first end member secured to the base member and configured to support a first lateral wall of the well cellar excavation;

a first side member secured to the base member, and the first end member, the first side member configured to support a first longitudinal wall of the well cellar excavation; and a second side member secured to the planar base member and the first end member, the second side member configured to support a second longitudinal wall of the well cellar excavation;

a seal formed between a top surface of the planar base member and each of the first end member, the first side member, and the second side member;

third side member secured to the base member and configured to support the first lateral wall of the well cellar excavation, the third side member connecting the first side member to the first end member; and a fourth side member secured to the base member and configured to support the first lateral wall of the well cellar excavation, the fourth side member connecting the second side member to the first end member.

* * * * *